United States Patent [19]

Dumenil et al.

[11] 4,348,836

[45] Sep. 14, 1982

[54] AUTOMATIC BASE SEAL

[76] Inventors: Claude G. Dumenil; Louis P. Dumēnil, both of 4075, Route de Neufchatel, 76230 Bois-Guillaume, France

[21] Appl. No.: 149,489

[22] Filed: May 13, 1980

[30] Foreign Application Priority Data

May 16, 1979 [FR] France ..... 79 12424

[51] Int. Cl.[3] ..... E06B 7/20

[52] U.S. Cl. ..... 49/311; 49/313; 49/310

[58] Field of Search ..... 49/303, 306–308, 49/310–314

[56] References Cited

U.S. PATENT DOCUMENTS 3,118,193 1/1964 Oksland ..... 49/310
4,170,846 10/1979 Dumenil et al. ..... 49/303

FOREIGN PATENT DOCUMENTS 1104671 4/1961 Fed. Rep. of Germany ..... 49/311
2815244 10/1979 Fed. Rep. of Germany ..... 49/310

*Primary Examiner*—Kenneth Downey
*Attorney, Agent, or Firm*—Brisebois & Kruger

[57] ABSTRACT

Automatic base seal constituted of a profile molding destined to be attached to a panel, especially a door, pivoting in a door frame, and having an elongated sealing element able to pivot between a retracted position with respect to the base seal and a position of sealing when extended with respect to the latter under the effect of an actuating device.

The profile molding has a section permitting it to be placed in and attached to the inside of a channel made in the bottom edge of the panel.

6 Claims, 2 Drawing Figures

AUTOMATIC BASE SEAL

Figure 1:
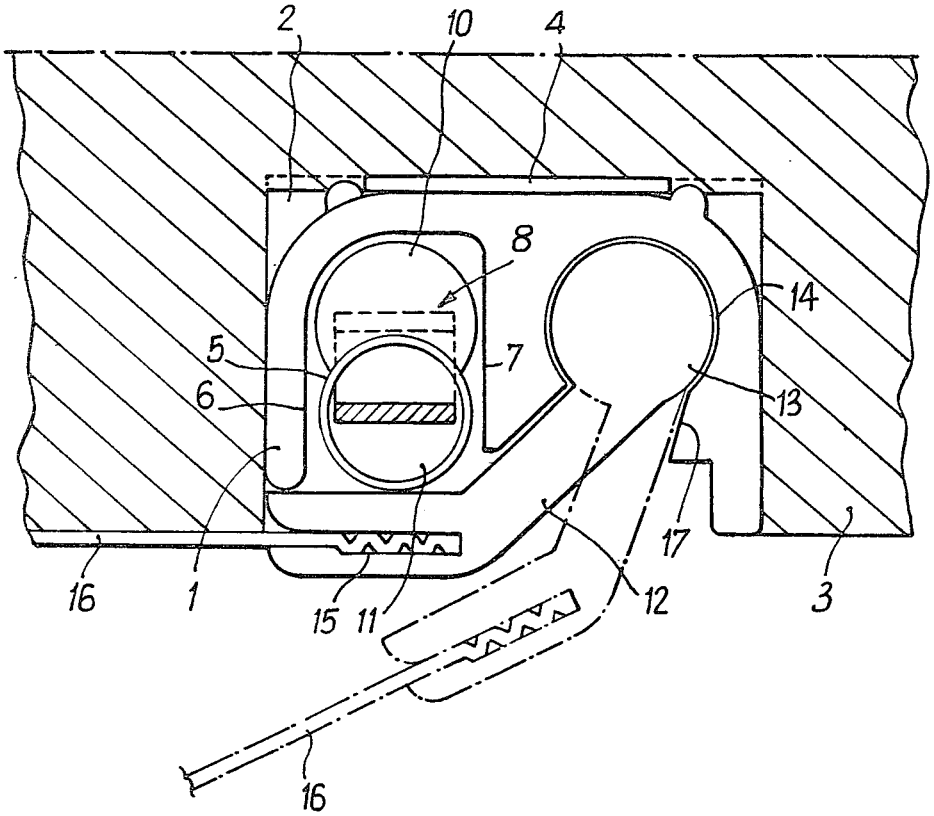

The present invention relates to an automatic base seal constituted of a profile molding designed to be fixed to a panel, particularly a door pivotable in a door frame, and comprising an elongated seal element, capable of being displaced between a retracted position, in relation to the base and an extended sealed position with respect to the latter under the effect of an actuating device. In their U.S. Pat. No. 4,170,846 the applicants have described a base seal of this type in which the profile molding contains at least two longitudinal internal grooves, the first receiving the actuating device for the pivoting seal element, and the second receiving in a pivoting fashion the sealing element, which in its retracted position in relation to the base seal extends generally along the first groove, the actuating device disposed in the first groove being capable during the closing of the panel to be at least partially extended out of the groove to make contact with the sealing element and to make it pivot.

The present invention proposes to provide an automatic base seal of this type, characterized over all by the fact that the profile molding presents a section notably quadrangular or in the shape of a U, permitting it to be put in place and fixed to the interior of a channel formed in the bottom edge of the panel.

Thus the base seal according to the invention, while presenting all the advantageous characteristics of function of the base seal according to the previous application, can be completely concealed in the interior of the panel. Advantageously, the profile molding has at its top surface means for fixing, for example by adhesive, against the bottom of the channel formed in the panel.

In order to render the base seal according to the invention as unnoticable as possible while assuring an excellent sealing effect, it is advantageous that the sealing element have at its extremity a flexible sealing tongue in the form of a strip made for example of polymethane thermo plastic elastomer or of a composite material formed of fiberglass embedded in polytetrafluoroethylene or silicon elastomer. This material gives the sealing strip, contrary to conventional elastomeric materials, and in addition to taking up little space, excellent holding properties under heat. The tongue in the form of a strip could have a thickness advantageously between 1 and 9 tenths of a mm, preferably of the order of 3 tenths of a mm.

The actuating device, which is made in the form of a deformable shaft, can advantageously be metallic and have at one of its ends a contact element for example cylindrical, extending beyond the end of the groove of the profile molding in the open position of the panel, and at its other end a second contact element also cylindrical opposed to the stop made in the corresponding groove of the profile molding. The actuating device has advantageously in its central portion a tubular part axially offset with respect to the contact element of the extremities and which assures contact with the sealing means to assure the pivoting of this part.

Figure 2:
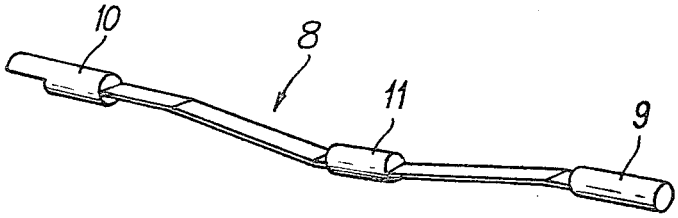

For the purpose of making the invention better understood, there will now be described by way of example, in no way limiting one embodiment referring to the attached drawings in which:

FIG. 1 is a cross section of the base seal according to the invention, mounted on a panel, the sealing element being shown in two positions of operation, FIG. 2 shows an actuating device usable in the base seal according to the invention.

The base seal according to the invention is constituted of a profile molding 1 presenting in a section the general form of a U. This profile molding 1 is fixed in a channel 2 of generally rectangular section made in the bottom edge of a movable panel such as a door 3. As is evident from FIG. 1, the molding 1 is considerably thinner than the thickness of door 3, so that a very narrow groove 2 in the bottom of the door is sufficient to accomodate the molding.

In the embodiment shown, the profile molding is attached by an adhesive strip at its top part against the bottom of the channel 2. It is, well understandably, possible to use other means of fixation.

The profile molding 1 has an internal groove 5 in the form of a trough, having generally parallel side walls 6 and 7. The wall 6 is advantageously folded back in order to form a stop for a shaft 8 forming the actuating device.

In the embodiment described, the shaft 8 is made, as one can see best on FIG. 2, in the shape of a metal strip comprising at its end which is to project from the panel, a cylindrical contact element 9 and at its opposite end another contact element 10 at least partially cylindrical and designed to abut against the folded back part of the wall 6 or any other stop element provided in groove 5. Shaft 8 has in addition in its central portion a tubular part 11 axially offset with respect to the end elements 9 and 10 and which assures contact with the sealing mechanism 12. One end 13 of sealing mechanism 12 is of generally circular section to engage in groove 14 of molding 1, which is generally circular in section.

The sealing element 12 has at its extremity opposite the one which engages in groove 14, a slot 15 in which is positioned a sealing strip 16 of a composite material made of fiberglass embedded in a silicon elastomer. The strip advantageously has a thickness of about 3 tenths of mm.

FIG. 1 shows the pivoting element of the seal 12 in a retracted position for opening the panel in solid lines, and in a position of use after closing of the panel in broken lines. The pivoting movement of the sealing means 12 can advantageously be limited by a stop 17 made on the profile molding 12. Suitable resilient means such as a spring can be used to return the sealing means 12 from its use position to its retracted position.

Even though the invention has been described with respect to one particular embodiment, it is very apparent that it is in no way limited and that one could carry out numerous modifications of shape or materials without going beyond either its scope or its spirit.

We claim:

1. Automatic base seal constituted of a profile molding to be attached to a panel, particularly a door, pivoting in a door frame, within an elongated rectangular channel formed in a bottom edge of the panel, said base seal comprising an elongated sealing means pivotable between a retracted position with respect to the base seal and a sealing position extended with respect to the latter under the effect of an actuating device, said profile molding having at least two internal longitudinal grooves in side by side relation to each other and within the confines of the profile molding, a first groove receiving the actuating device of the pivoting sealing element, and a second groove pivotally mounting the sealing element which, in its retracted position with respect to the base seal, extends generally across the first groove, said actuating device in the first groove being operable in response to closing the panel to be at least partially extended downwardly from said first groove to engage and pivot the sealing element to its sealing position, said profile molding comprising an inverted U-shaped section permitting it to be positioned in and attached to the inside of the rectangular channel formed in the bottom edge of the panel, and wherein the sealing element pivoting in the profile molding has at its extremity a flexible sealing lip made in the form of a strip having a cross section between 1 and 9 tenths of a mm.

2. Automatic base seal according to claim 1 wherein said lip has a cross section on the order of 3 tenths of a mm.

3. Automatic base seal according to claim 1 wherein said profile molding has on its top face, means for attachment against the bottom of the channel made in the panel.

4. Automatic base seal according to claims 1, 2 or 3 wherein the actuating device comprises a metal shaft having at one of its ends, a generally cylindrical contact element extending beyond the end of the first groove of the profile molding, in the open position of the panel, and at the other end a second at least practically cylindrical contact element, said shaft having in the vicinity of its central portion a tubular part axially offset with respect to said contact elements of the ends.

5. Automatic base seal according to claims 1, 2, or 3 wherein said sealing lip, in the retracted position of the sealing element, extends across the bottom edge of the panel adjacent the rectangular channel.

6. Automatic base seal according to claim 4, wherein, said sealing lip, in the retracted position of the sealing element, extends across the bottom edge of the panel adjacent the rectangular channel.

* * * * *